US007134363B2

(12) United States Patent
Krallman

(10) Patent No.: US 7,134,363 B2
(45) Date of Patent: Nov. 14, 2006

(54) DEADBLOW HAMMER

(76) Inventor: Anthony Krallman, 16205 Ward Way, City of Industry, CA (US) 91745

( * ) Notice: Subject to any disclaimer, the term of this patent is extended or adjusted under 35 U.S.C. 154(b) by 0 days.

(21) Appl. No.: 11/106,126

(22) Filed: Apr. 13, 2005

(65) Prior Publication Data

US 2005/0193868 A1 Sep. 8, 2005

Related U.S. Application Data

(63) Continuation of application No. 10/246,867, filed on Sep. 17, 2002, now Pat. No. 6,904,829.

(51) Int. Cl.
*B25D 1/00* (2006.01)
*B25D 1/12* (2006.01)

(52) U.S. Cl. ..... 81/22; 81/20; 81/22; 81/25; 81/26

(58) Field of Classification Search ..... 81/20, 81/22, 25, 26
See application file for complete search history.

(56) References Cited

U.S. PATENT DOCUMENTS

| | | | | |
|---|---|---|---|---|
| 1,045,145 A | | 11/1912 | Hubbard | |
| 2,604,914 A | | 7/1952 | Kahlen | |
| 2,737,216 A | * | 3/1956 | Kenerson | 81/22 |
| 3,130,762 A | | 4/1964 | Kerr | |
| 4,039,012 A | | 8/1977 | Cook | |
| 4,085,784 A | | 4/1978 | Fish | |
| 4,831,901 A | * | 5/1989 | Kinne | 81/25 |
| 5,375,486 A | | 12/1994 | Carmien | |
| 5,537,896 A | | 7/1996 | Halder | |
| 5,613,916 A | | 3/1997 | Sommer | |
| 5,899,821 A | | 5/1999 | Hsu et al. | |
| 5,916,338 A | | 6/1999 | Bergkvist et al. | |
| 5,960,677 A | | 10/1999 | Carmien | |
| 6,052,885 A | | 4/2000 | Carmien | |
| 6,234,048 B1 | | 5/2001 | Carmien | |
| 6,311,582 B1 | | 11/2001 | Chow | |
| 6,536,308 B1 | * | 3/2003 | Thorne et al. | 81/20 |
| 2002/0169033 A1 | | 11/2002 | Sery | |

OTHER PUBLICATIONS

Notification of Transmittal of the International Search Report or the Declaration dated Feb. 3, 2004 and mailed Feb. 26, 2004 for International Application No. PCT/US03/24176 and International Filing Date Jul. 31, 2003 (5 pgs).
Notification of Transmittal of International Preliminary Examination Report dated Nov. 23, 2004 and mailed Dec. 8, 2004 for International Application No. PCT/US03/24176 and International Filing Date Jul. 31, 2003 (16 pgs).

* cited by examiner

*Primary Examiner*—Joseph J. Hail, III
*Assistant Examiner*—Shantese McDonald
(74) *Attorney, Agent, or Firm*—Christie Parker & Hale, LLP.

(57) ABSTRACT

Deadblow hammers capable of minimizing or eliminating recoils when the hammers impact their targets are discussed which have easy access anti-recoil chambers and which have open sockets for receiving handles that extend the length of the hammerhead body. These hammers incorporate filler materials, which function to negate the effects of the hammer recoils, with improved filling port(s) for filling the filler materials. Golf clubs with anti-recoil chamber and insert elements are also discussed.

13 Claims, 9 Drawing Sheets

FIG. 7
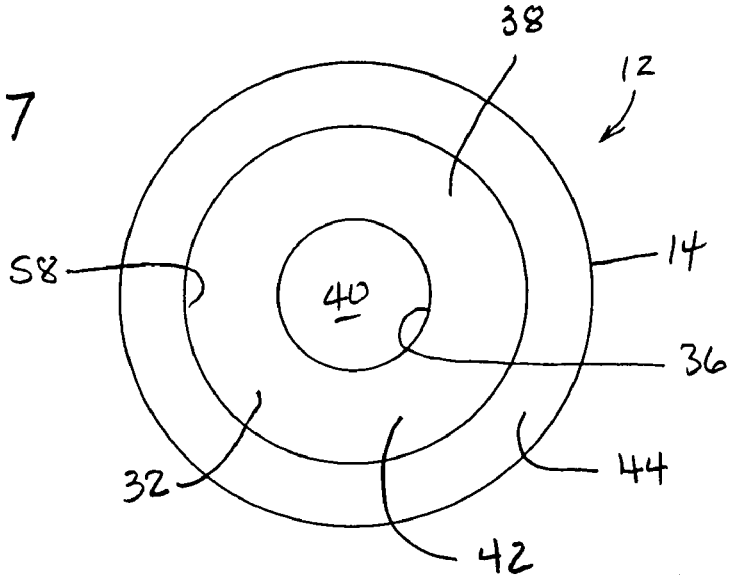
FIG. 8
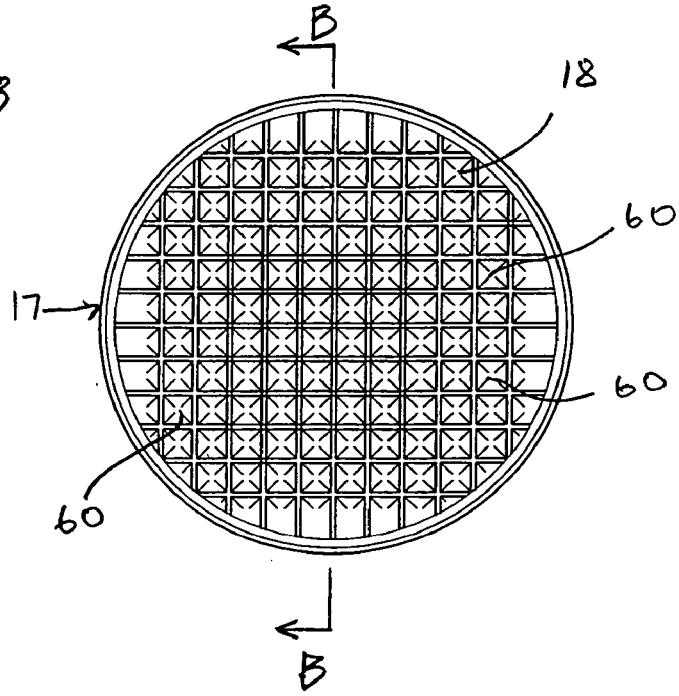
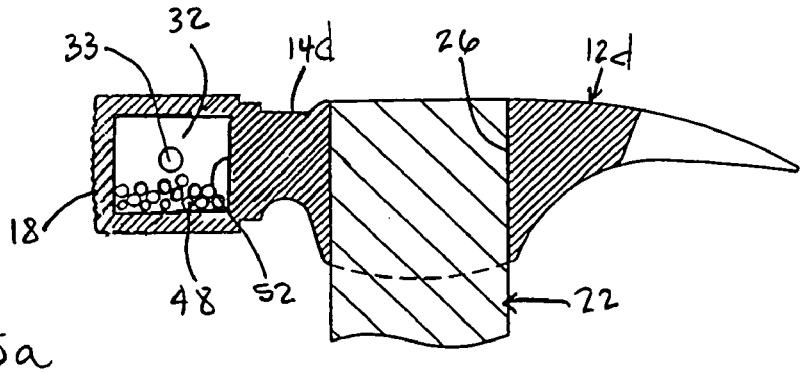
FIG. 5a

DEADBLOW HAMMER

CROSS-REFERENCE TO RELATED APPLICATION

This is a continuation application of Ser. No. 10/246,867, filed Sep. 17, 2002 now U.S. Pat. No. 6,904,829, entitled Deadblow Hammer, the contents of which are expressly incorporated herein by reference.

Deadblow hammers capable of minimizing or eliminating recoils when the hammers impact their targets are discussed herein. These hammers incorporate filler materials, which function to negate the effects of the hammer recoils, with improved filling port(s) for filling the filler materials.

BACKGROUND

It is a well-known principle that every action has is an equal and opposite reaction (Newton's Third Law). Thus, for a hammer, when the impact surface of the hammerhead impacts a target, the hammer is jolted backwards due to the reaction caused by the hammerhead striking its target. This opposite reaction is commonly referred to as hammer recoil.

For minimizing or eliminating hammer recoils, which cause vibrations and injuries to the user, numerous hammers were invented. Broadly speaking, these hammers utilize some form of inserts placed in a hollow chamber within the hammerhead, or within a separate hollow body having a hollow chamber attached to the hammerhead. The inserts are configured to move from a rear surface of the hollow chamber to a front surface of the hollow chamber. Accordingly, when the hammer moves in a first direction to impact its target, the inserts are pushed by the rear surface of the hollow chamber to move in the same first direction.

As the impact surface of the hammerhead impacts a target and starts its recoil in a second direction, the inserts still move in the first direction within the hollow chamber and impact the front surface of the hollow chamber, in the first direction. The inserts impacting against the front surface of the hollow chamber thus cancel the recoil in total or substantially. The amount of cancellation depends, in part, on the weight percentage of the inserts compared to the weight of the hammerhead. Without being restricted to any particular theory, the deadblow impact or feel to the user also depends on the distance the insert travels before it impacts the front surface, which will influence how far the hammer recoils before the insert impacts the front surface to cancel out the effect.

U.S. Pat. No. 6,234,048 to Carmien discloses a non-recoil hammer, with a hammerhead that has an open socket for receiving a separate hollow canister. The hollow canister connects to a tool handle and contains a relatively high mass moveable filler material in a hollow chamber, such as steel shot pellets. The hollow canister is received within the open socket to form a completed hammer. Due to the two-piece design, the hammer is more complicated and costly to manufacture.

U.S. Pat. No. 5,916,338 to Bergkvist et al. discloses a hammer having a hammerhead with an impact element and a cavity at least partially filled with particulate material, such as steel shot, so as to dampen the recoil of the hammer. The impact element is forged with the head as a single piece or may be formed as a separate part that is connected to the head by welding. However, since the cavity extends the full length of the hammerhead, the handle cannot attach to the hammerhead by passing through central portion of the hammerhead, but is attached via partial through hole at the central portion of the hammerhead. This makes the handle more susceptible to slippage or separation from the hammerhead. Furthermore, because of the cavity, a conventional handle with a split end for wedging the handle with a wedge is not useable with the disclosed hammerhead.

U.S. Pat. No. 4,039,012 to Cook discloses a non-rebound hammer having a hammerhead portion with forwardly and rearwardly facing metallic impact surfaces. The head portion contains a hollow cylindrical core for receiving a quantity of pellets, such as small lead shots. The hammerhead also contains a core hole for receiving a handle rod. The handle rod and the hammerhead are then co-molded with an encasement. Due to the co-molded configuration, the entire hammer must be discarded when damage is done to the handle.

U.S. Pat. No. 2,604,914 to Kahlen discloses a hammerhead having a rebound-preventing means. The hammerhead has a body with a striking head at each end of the body. Each striking head is formed integrally with the body, or alternatively it may be secured to the body as a separate piece. A chamber is formed in the body immediately behind the striking heads. The chamber contains irregularly shaped particles 26, as shown in FIG. 3 of the '914 patent. The particles almost completely fill the chamber, with the total weight of the particles dependent on the recoil quality of the striking head, the size of the hammer, and the weight of the head. Due to the lengthwise chamber, a ferrule is used to connect a handle to the body. This makes the body unnecessarily bulky.

There is therefore a need for a non-recoil hammer or deadblow hammer that minimizes or negates the effects of hammer recoils and that do so without the shortcomings of prior art deadblow hammers. Additionally, there is also a need for a method of making the desired deadblow hammer.

SUMMARY

The present invention specifically addresses and alleviates the above-mentioned deficiencies associated with the prior art anti-recoil hammers. More particularly, the present invention comprises a deadblow hammer comprising a hammerhead having a body, an anti-recoil chamber for receiving a plurality of insert elements located within a section of the body, and an open socket defined by a handle chamber which passes through the body for receiving a handle. The anti-recoil chamber comprises a first opening that is in communication with the open socket and that provides a first passage into the anti-recoil chamber, the first opening allows the plurality of insert elements to be placed into the anti-recoil chamber by way of the open socket; and wherein insertion of the handle into the handle chamber seals off the first opening and occupies the open socket. Together, these features define a deadblow hammer that is more economical to make and that has an anti-recoil chamber that is easy to access.

The present invention also involves a deadblow hammer comprising a hammerhead having a body, two anti-recoil chambers, each having a plurality of insert elements situated therein and an impact surface attached adjacent thereto, and an open socket defined by a handle chamber that passes through the body for receiving a handle. This hammer is commonly known in the art as a sledge hammer.

The two anti-recoil chambers in the sledge hammer each comprising a first opening that is in communication with the open socket and that provides a first passage into the anti-recoil chamber from the open socket; the first opening allows the plurality of insert elements to be placed into the anti-recoil chamber by way of the open socket; and wherein an insertion of the handle into the handle chamber seals off the first opening of each of the anti-recoil chamber and causes the open socket to be occupied.

The present invention also involves a golf club head comprising a club face, a hosel for attaching the club head to a shaft, and a hollow chamber disposed within the club head; and wherein the hollow chamber includes insert elements for negating and dampening recoils when the golf club head impacts a solid surface.

BRIEF DESCRIPTION OF THE DRAWINGS

These and other features, aspects and advantages of the present invention will be more fully understood when considered with respect to the following detailed description, appended claims and accompanying drawings, wherein:

FIG. 5*a* is a semi-schematic cross-sectional side view of the hammer of FIG. 2 with side openings;

FIG. 7 is a semi-schematic end view of the hammer of FIG. 2 taken at line A—A;

FIG. 8 is a semi-schematic end view of the impact plate provided in accordance with practice of the present invention;

DETAILED DESCRIPTION

The detailed description set forth below in connection with the appended drawings is intended as a description of the presently preferred embodiments of the deadblow hammer in accordance with the present invention and is not intended to represent the only forms in which the present invention may be constructed or utilized. The description sets forth the features and the steps for constructing and using the deadblow hammer of the present invention in connection with the illustrated embodiments. It is to be understood, however, that the same or equivalent functions and structures may be accomplished by different embodiments that are also intended to be encompassed within the spirit and scope of the invention. Also, as denoted elsewhere herein, like element numbers are intended to indicate like or similar elements or features.

Figure 1:
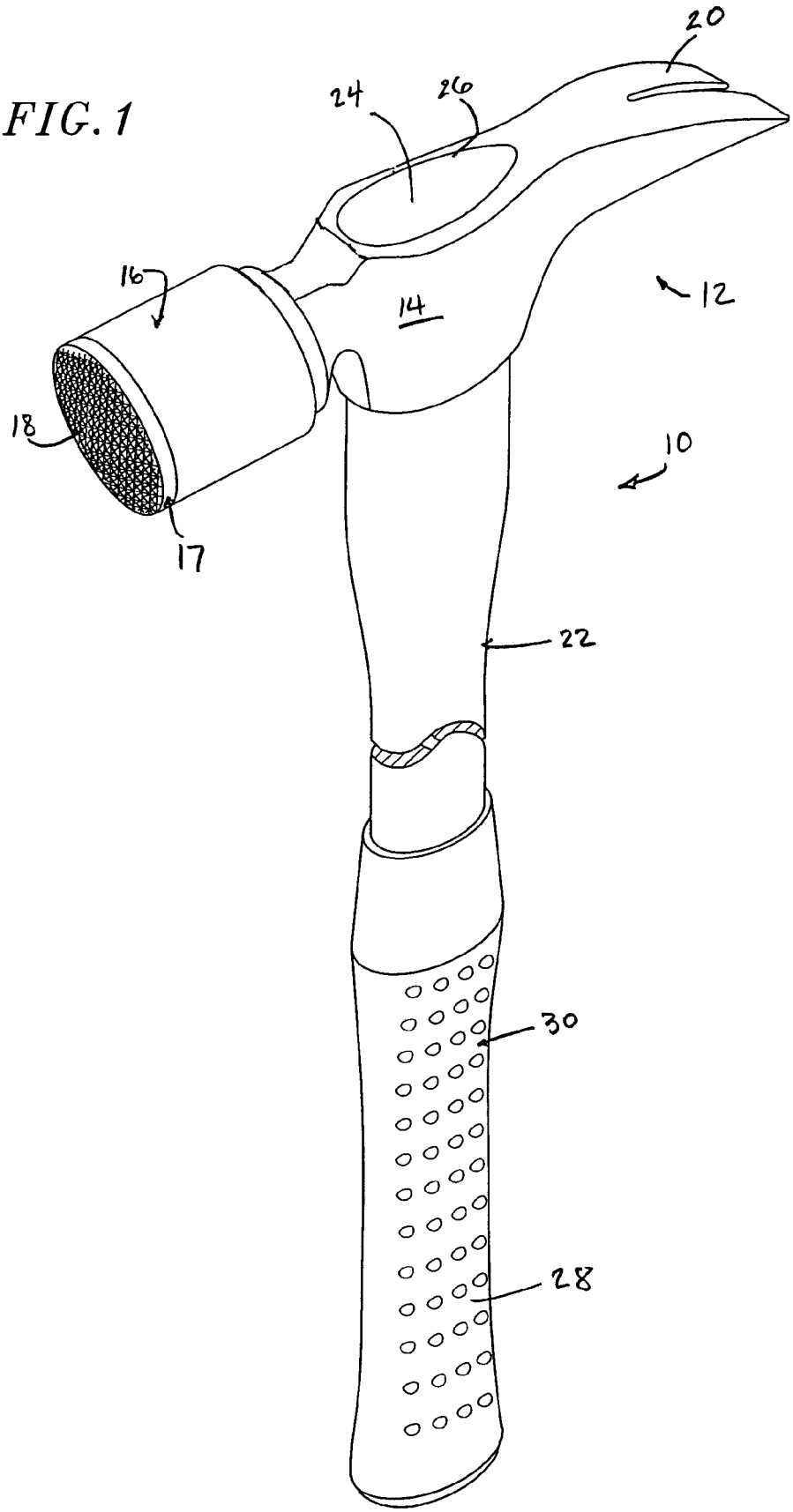
FIG. 1 is a semi-schematic perspective view of an exemplary deadblow hammer provided in accordance with practice of the present invention.

Referring now to FIG. 1, there is shown a deadblow hammer ("hammer") provided in accordance with practice of the present invention, which is generally designated 10. The hammer 10 comprises a hammerhead 12, which includes a body 14, an impact section 16, an impact plate 17 having an impact surface 18 and a claw 20. The hammer 10 further comprises a handle 22, which includes an attachment portion 24 for attaching to the open socket 26 of the hammerhead 12 and a handle portion 28 for facilitating gripping of the hammer 10. The handle 22 is shown with an optional handle grip 30, which may be made from a rubber material and slidably inserted over the handle portion 28 of the handle 22.

The hammerhead 10 is preferably cast from a steel material but alternatively may be forged from a steel block. The handle 22 may be any number of conventional handles, including handles made from wood, plastic, and fiberglass.

Figure 2:
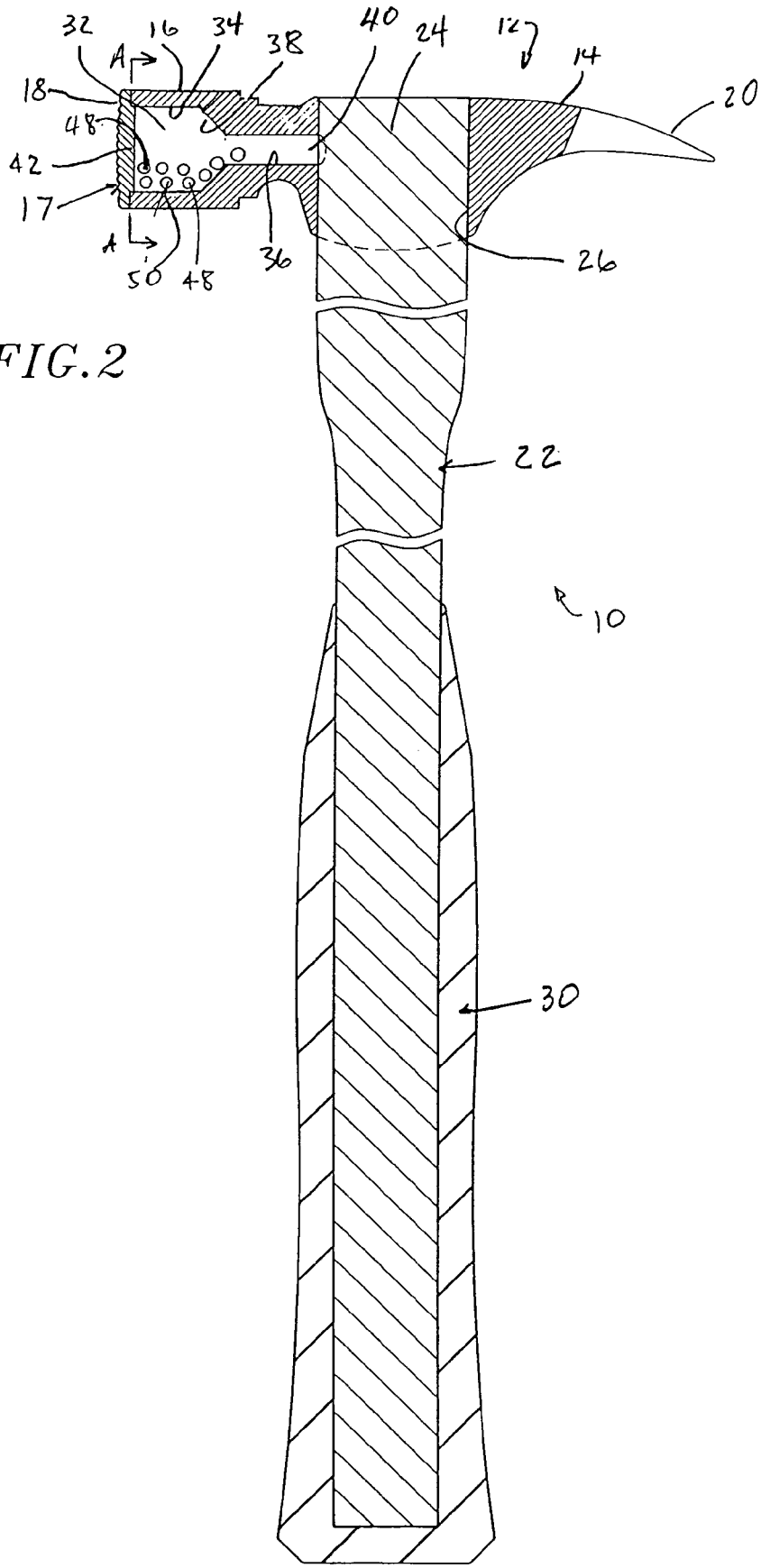
FIG. 2 is a semi-schematic cross-sectional side view of the deadblow hammer of FIG. 1.

Referring now to FIG. 2, there is shown a semi-schematic cross-sectional view of the hammer 10 of FIG. 1. As shown, the hammerhead 12 comprises a hollow chamber 32, which is also referred to herein as an anti-recoil chamber. The hollow chamber 32 comprises an enlarged chamber section 34, a relatively smaller tail chamber section 36, and a tapered transitional section 38. The tapered transitional section 38 may include a straight taper, as shown, or a curved taper. The hollow chamber 32 further includes a first opening 40 that is just proximal of the tail chamber section 36. The first opening 40 opens into the open socket 26 and is in communication with the open socket. However, once the handle 22 is inserted into the open socket 26, the communication is severed and the attachment portion 24 of the handle occupies the open socket (FIG. 2). Although the open socket 26 is shown with a straight wall, it is understood that a tapered wall may be incorporated without deviating from the scope of the present invention.

A separate impact plate 17 is shown attached to the body 14 of the hammerhead 12 and covers the hollow chamber's second opening 42. The second opening 42 is shown larger than the first opening 40. However, the arrangement is merely a designer's choice as the relative dimensions between the first opening 40 and the second opening 42 may be reversed. The impact plate 17 may be attached to the body 14 by conventional welding methods, by threads, or by inertia welding. In inertia welding, the body 14 is held in a lath and spins at relatively high speed. The lath used for inertia welding can be a vertical standing lath or a horizontal lath. The impact plate 17, which is not spinning, is then pushed against the spinning end surface 44 of the second opening 42. The friction generated by the contact causes the impact plate 17 and the end surface 44 to partially melt, which results in their fusion. As a by-product of their impact, a protruding section 46 is formed on the impact plate 17, which protrudes into the hollow chamber 32. Alternatively, the impact plate 17 can be rotated in the lath and the body 14 held stationary.

A plurality of insert elements 48 are shown placed in the hollow chamber 32. The insert elements 48 can be any number of weighted materials such as spherical pellets, small metal scraps, lead shots, or their equivalence. In one embodiment, steel pellets 50 are used for the insert elements 48. The quantity of steel pellets 50 used is approximately equal to 25% to 70% of the weight of the hammerhead 12 with 30% to 60% being more preferred. In another embodiment, tungsten shots are used for their relatively heavier density than steel. Consequently, less space or volume is required for the same weight percentage when tungsten shots are used.

Figure 2A:
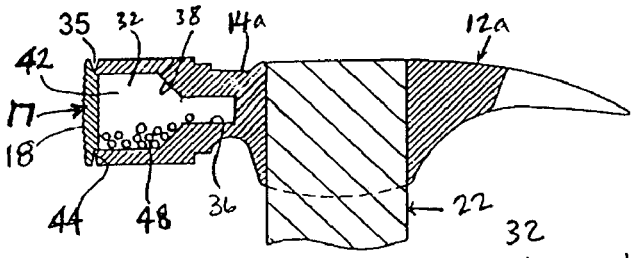
FIG. 2A is a semi-schematic cross-sectional view of the deadblow hammer of FIG. 1 with a v-groove.

The insert elements 48 are added to the hollow chamber 32 by individually depositing the steel pellets 50 in through the first opening 40, before attaching the handle 22 into the open socket 26 and after attaching the impact plate 17 to the end surface 44. Alternatively, the steel pellets 50 may be added to the hollow chamber by first magnetizing the pellets or gluing the pellets so that they form a single large mass. The single large mass can then be added to the hollow chamber via the second opening 42, before attaching the impact plate 17 to the end surface 44. Subsequently, the impact plate 17 may be attached to the end surface 44 by inertia welding, using a vertical standing lath, or by conventional welding. Due to the size of the single large mass, it will not fall out of or fall through the first opening 40 when the welding is taking place. It is understood that if conventional welding is utilized to attach the impact plate 17 to the end surface 44, the surfaces to be welded should be chamfered to provide a v-groove 35 for welding, See, e.g., FIG. 2A.

Figure 3:
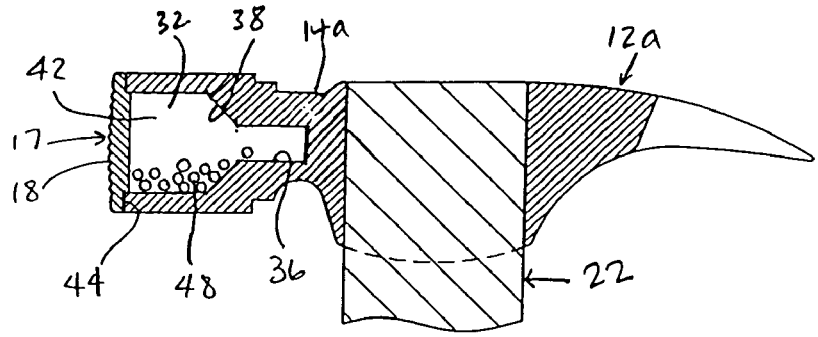
FIG. 3 is a semi-schematic cross-sectional side view of the hammer of FIG. 2 with an alternative anti-recoil chamber.

Turning now to FIG. 3, there is shown an alternative hammerhead 12*a* provided in accordance with practice of the present invention. The hammerhead includes a single large opening 42 leading into the hollow chamber 32. The smaller opening has been eliminated from the hammerhead 12 shown in FIG. 2, but the tail chamber section 36 and the tapered transitional section 38 still incorporated. The hammerhead 12*a* may be made by casting or forging the body 14*a* separately from the impact plate 17. The insert elements 48 may be added to the hollow chamber 32 and the impact plate 17 welded to the end surface 44 of the body 14*a* in the same fashion as discussed above with reference to FIG. 2.

Figure 4:
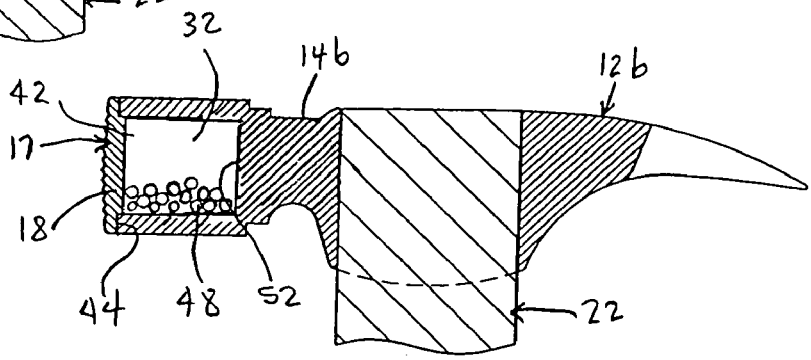
FIG. 4 is a semi-schematic cross-sectional side view of the hammer of FIG. 2 with another alternative anti-recoil chamber.

Turning now to FIG. 4, there is shown another alternative hammerhead 12*b* provided in accordance with practice of the present invention. The hammerhead 12*b* includes a single large opening 42 leading into the hollow chamber 32. The hollow chamber 32 is preferably cylindrical but may take on other or additional contours, such as a slight taper from the large opening 42 towards the back wall 52 of the hollow chamber. The hammerhead 12*b* may be made by casting or forging the body 14*b* separately from the impact plate 17. The insert elements 48 may be added to the hollow chamber 32 and the impact plate 17 welded to the end surface 44 of the body 14*b* in the same fashion as discussed above with reference to FIG. 2.

Figure 5:
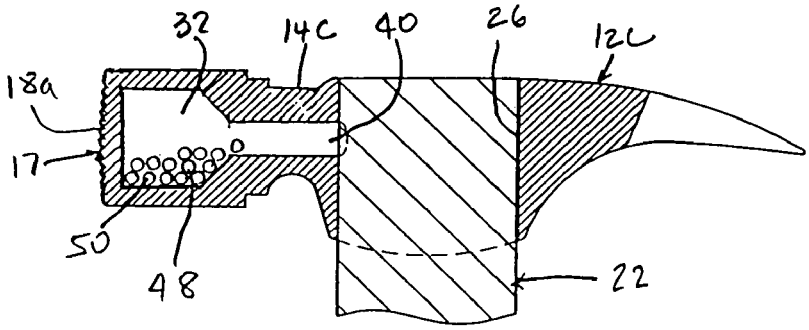
FIG. 5 is a semi-schematic cross-sectional side view of the hammer of FIG. 2 with yet another alternative anti-recoil chamber.

Turning now to FIG. 5, there is shown yet another alternative hammerhead 12*c* provided in accordance with practice of the present invention. The hammerhead 12*c* includes a single small opening 40 that leads into the hollow chamber 32, as shown in FIG. 2. However, the impact plate 17 is now integrally formed with the body 14*c*. The hammerhead 14*c* is therefore made from casting only, as further discussed below. The insert elements 48 may be added to the hollow chamber 32 by adding the individual pellets in through the small opening 40 before inserting the handle 22 into the open socket 26, as discussed above with reference to FIG. 2.

FIG. 5*a* shows still yet another alternative hammerhead 12*d* provided in accordance with practice of the present invention. Similar to the other embodiments (i.e., FIGS. 1–5), the present embodiment preferably includes two openings 33, one on each of the left and right side surface of the hammerhead body 14*d* and each being in communication with the hollow chamber 32. The impact surface 18 is integrally cast with the body 14*d* and the open socket 26 extends through the body without an opening, like the embodiment of FIG. 5. Thus, the insert elements 48 are added to the hollow chamber 32 via the side openings 33 and then subsequently sealed by plugs or caps. Alternatively, the openings 33 may be located along the upper and lower side surfaces of the hammerhead body 14*d*, and may take on 1 or more than 2 openings. The present embodiment, as well as other embodiments disclosed elsewhere herein, allows a conventional handle with a split attachment portion 24 to be used as it permits a wedge or several wedges to be inserted into the split attachment portion from the top of the open socket to wedge-in or lock-in the handle.

Figure 6:
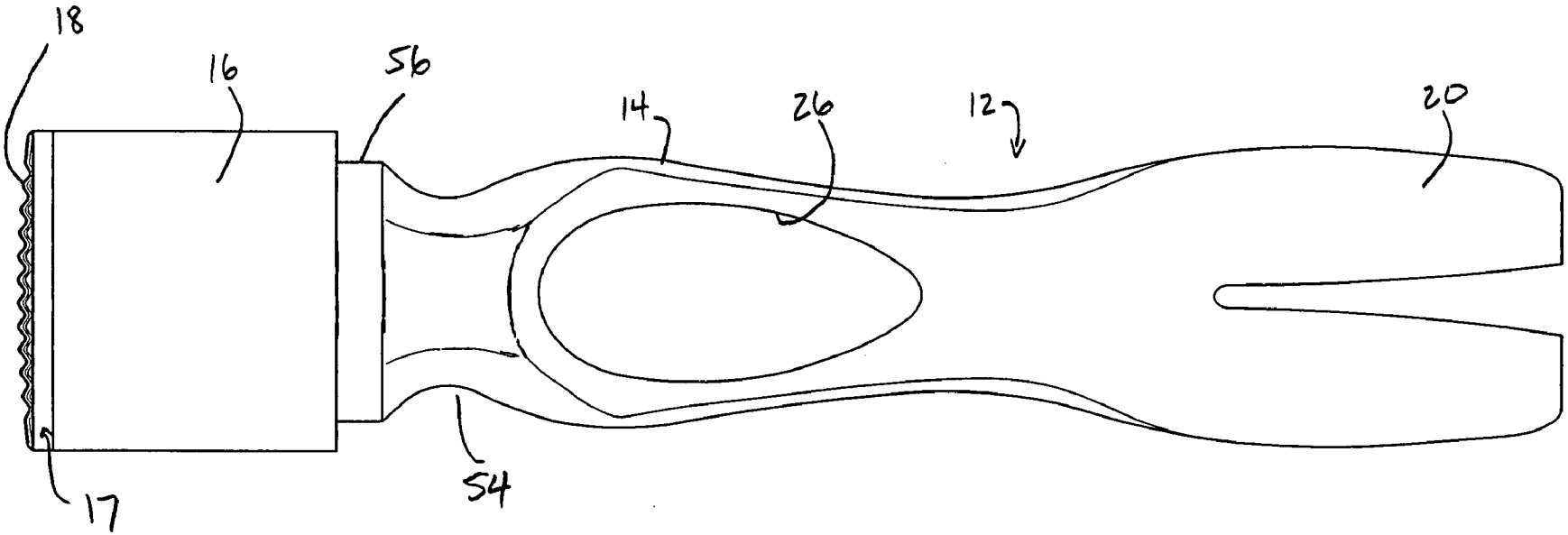
FIG. 6 is a semi-schematic plan view of the hammer of FIG. 1.

FIG. 6 is a top view of the hammerhead 12 of FIGS. 1–5. Although shown with the particular impact plate 17, impact section 16, open socket, and claw 20, it is understood that the hammerhead 12 may vary in any of these features, and in addition, in length, width, tapered neck section 54, stepped collar section 56 (located in between the impact section 16 and the tapered neck section), etc. without deviating from the scope the present invention. For example, the present invention may be practiced by varying the metallurgy, the overall hammerhead weight, and replacing the claw 20 with another impact section, as further discussed below.

FIG. 7 is an end view of the hammerhead 12 of FIG. 2 taken at line A—A. As shown, the large opening 42 opens into the hollow chamber 32, which has a circular chamber surface 58. The circular chamber surface 58 intersects the transitional section 38, which connects to the tail chamber section 36, which terminates into the small opening 40.

FIG. 8 is an end view of the impact plate 17 provided in accordance with practice of the present invention. The impact plate 17 includes an impact surface 18 having an array of bumps or serrations 60, which may be formed from casting, forging, or machining from bar stocks. However, a smooth surface or a dispersed array of bumps may be used instead of the serrated impact surface 18.

Figure 9:
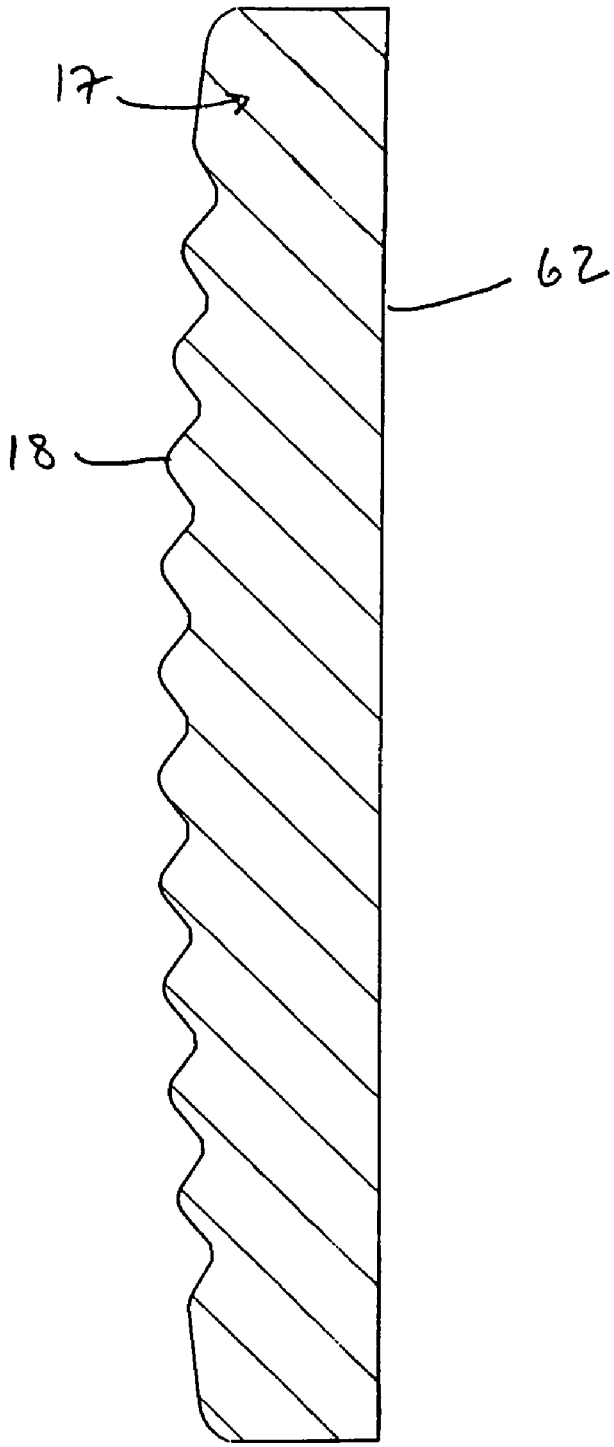
FIG. 9 is a semi-schematic cross-sectional view of the impact plate of FIG. 8 taken at line B—B.

FIG. 9 is a semi-schematic cross-sectional view of the impact plate 17 of FIG. 8 taken at line B—B. As evident by FIG. 9, a neck or stepped surface on the rear surface 62 of the impact plate 17 is not necessary as a protruding section 46 will form as a by-product of the inertia welding (See, e.g., FIG. 2).

Figure 10:
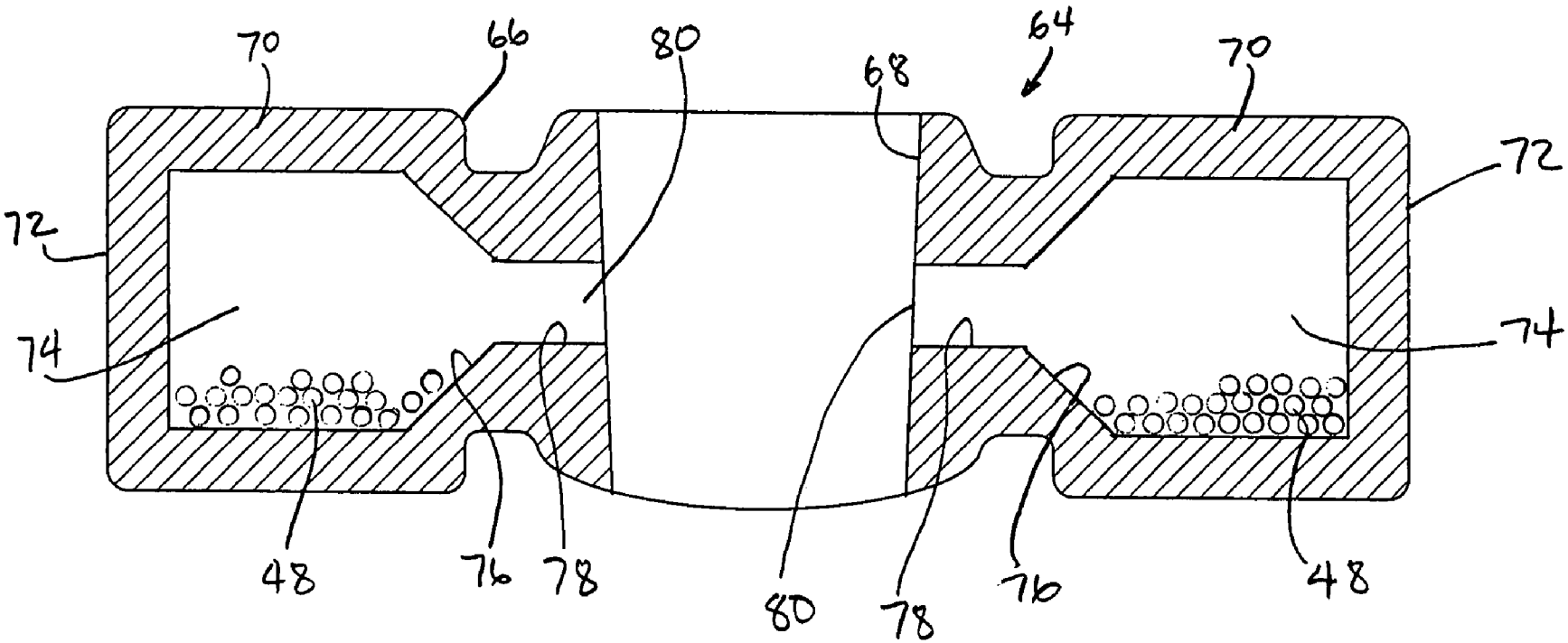
FIG. 10 is a semi-schematic cross-sectional view of an alternative hammerhead provided in accordance with practice of the present invention.

FIG. 10 shows an alternative hammerhead provided in accordance with practice of the present invention, which is generally designated 64. The hammerhead 64 is commonly found in a sledge hammer. In particular, the hammerhead 64 comprises a body 66, a central open socket 68 (which is shown with a tapered surface but may include a straight surface), and two impact sections 70 with integrally molded impact surfaces 72. The hammerhead 64 further includes two hollow chambers 74, one in each of the impact section 70. Each hollow chamber 74 includes a tapered transition section 76 that leads to a tail chamber section 78 and that leads to an opening 80. As previously discussed with reference to, for example, FIGS. 1, 2, and 5, the insert elements 48 may be added to each of the hollow chamber 74 by way of the small opening 80, and preferably in equal amount. As before, the total insert elements should range from about 25% to 70% of the weight of the hammerhead 64, with about 30% to 60% of the total weight being more preferred.

Although the hammerhead 64 is shown with integrally formed impact surfaces 72, separate impact plates may be used and thereafter welded to the body 66, as previously discussed with reference to FIGS. 2–4. If separate impact plates are used, the small openings 80 may be eliminated from the hammerhead 64, such as that shown in FIGS. 3 and 4.

Figure 11:
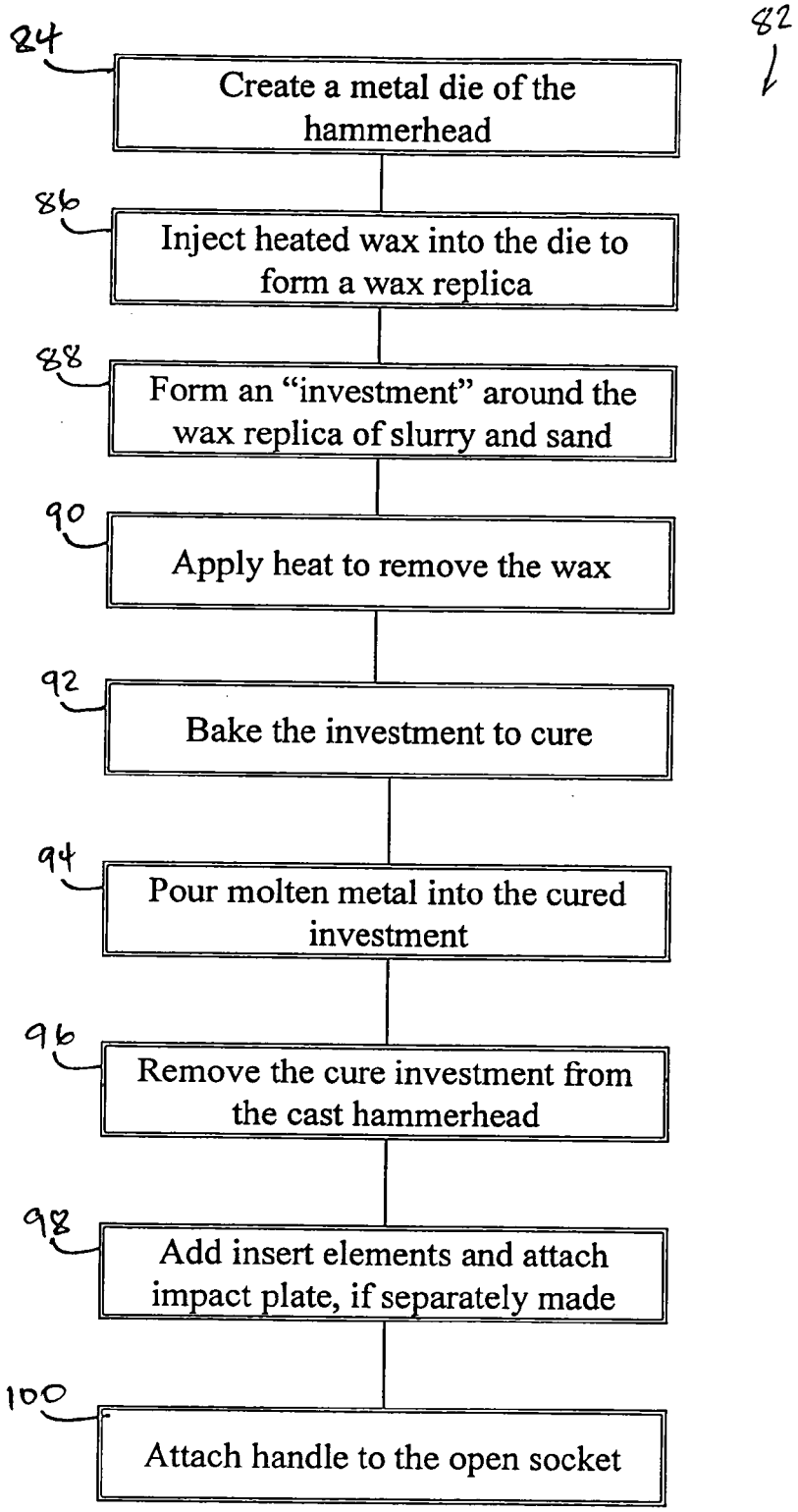
FIG. 11 is a manufacturing flow diagram provided in accordance with practice of the present invention.

FIG. 11 is a block flow diagram 82 of an exemplary manufacturing method provided in accordance with practice of the present invention. As shown, the method includes creating a metal die for the hammerhead 84. The metal die for the hammerhead can take on any number of configurations, including a hammerhead with a single opening, an integral impact surface, a sledge hammerhead, a finishing hammerhead, or a framing hammerhead, just to name a few.

Next, melted wax is pour into the die to create a wax replica of the hammerhead 86. The wax is then dipped into a slurry bath comprising silica flour and a chemical binder to form an "investment" 88. After the investment hardens, the wax is removed from the investment by heating the investment and the wax in an oven or a steam chamber 90 to melt the wax. Once the wax is removed, the investment is baked or fired in a heater 92 to cure. Molten metal is then poured into the cured investment 94 to form the cast hammerhead.

Once the cast hammerhead sufficiently cools, the investment is removed 96 by impacting the hammerhead to break up the investment. The hammerhead is now ready to receive the insert elements 98. As discussed above with reference to FIGS. 2–5, if the impact plate is separately produced, the impact plate is then attached to the hammerhead via welding. A handle is then attached to the hammerhead 100 to complete the deadblow hammer.

Figure 12:
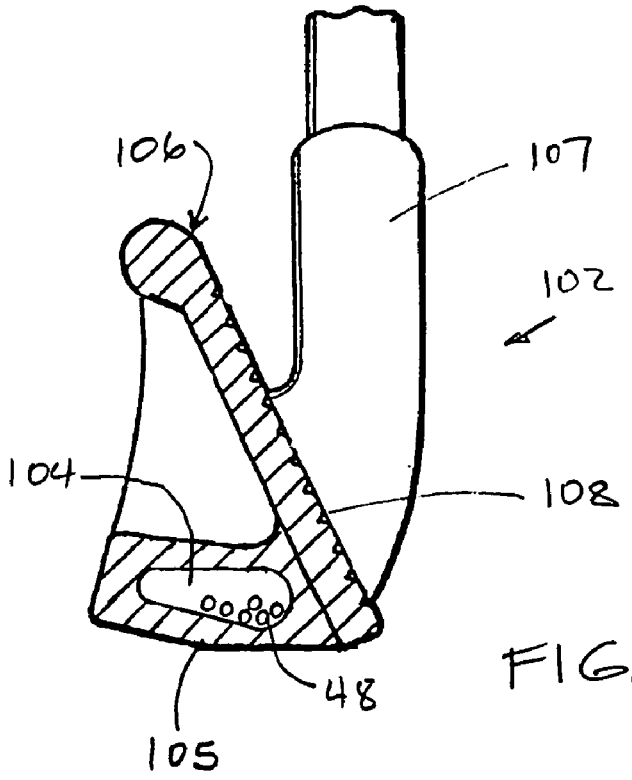
FIG. 12 is a metal golf club having an anti-recoil chamber provided in accordance with practice of the present invention.

FIG. 12 depicts a metal golf club 102 that incorporates a hollow chamber 104 for receiving insert elements 48. The golf club head 106 is preferably cast so that the hollow chamber 104 may be formed into the sole 105 of the club head during fabrication. The hosel 107 shown can be any prior art hosel, including an offset hosel or a more conventional hosel for attaching to a shaft. The hollow chamber 104 preferably runs the width of the club face 108 (the direction that is perpendicular to the viewing plane) and is sealed by a cap (not shown). The cap can be attached to the club head 106 by welding. In an exemplary embodiment, steel pellets making up about 10% to 50% of the club head 10 is used to dampen the vibration and the recoil effects of the club head 106 as the club face 108 miss hits and strikes the ground. Exemplary metal golf clubs are disclosed in U.S. Pat. No. 6,344,000, which is incorporated herein by reference.

Figure 13:
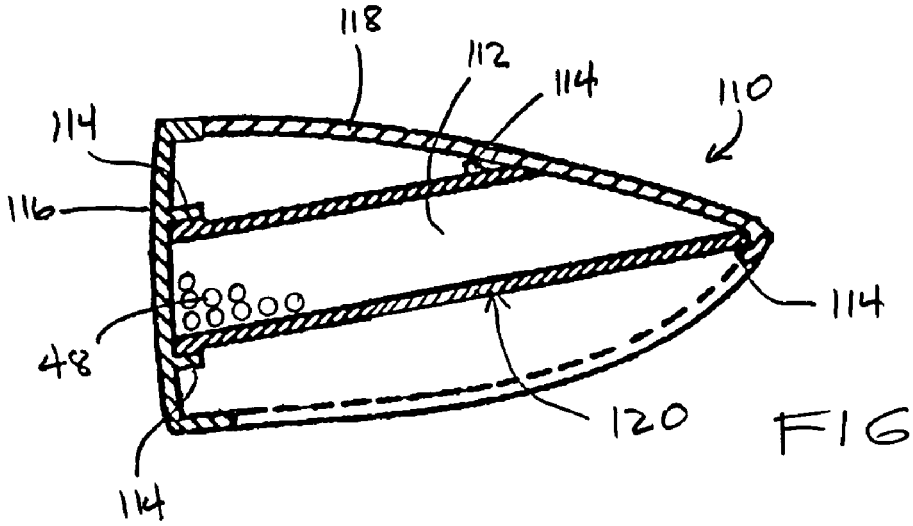
FIG. 13 is a metal wood golf club having an anti-recoil chamber made from a tube provided in accordance with practice of the present invention.

FIG. 13 depicts a metal wood golf head 110 that incorporates a hollow chamber 112 for receiving insert elements 48. The hollow chamber is formed by attaching retaining clips 114 to the club face 116 and to the shell 118 and connecting a hollow tube 120 thereinbetween. Although a hosel is not shown, it is understood that any prior art hosel may be incorporated into the golf club head 110 for attaching to a shaft. Similar to the golf club head of FIG. 12, the insert elements 48 preferably make up about 10% to about 50% of the weight of the metal wood 110. Exemplary metal wood golf clubs are disclosed in U.S. Pat. No. 5,873,791, which is incorporated herein by reference.

Although the preferred embodiments of the invention have been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims. Various changes to the hammerhead and golf club head may be made including changing the contour, the weight, the hollow chamber configuration, and the overall dimensions, etc. Accordingly, many alterations and modifications may be made by those having ordinary skill in the art without deviating from the spirit and scope of the invention.

What is claimed is:

1. A deadblow hammer comprising a hammer head comprising an impact surface defining an impact plane; a nail pulling claw; a handle chamber defining a handle axis; and a handle attached to the handle chamber; the hammer head comprising an opening, positioned on a plane at an angle to the impact plane, in communication with an anti-recoil chamber, the anti-recoil chamber positioned substantially to one side of the handle axis; wherein a plurality of insert elements is disposed in the anti-recoil chamber by way of the opening, which is sealed subsequent to placement of the plurality of insert elements, and wherein the opening is smaller than the interior dimension of the anti-recoil chamber.

2. The deadblow hammer of claim 1, wherein the handle extends through the handle chamber such that the handle is visible from two open ends of the handle chamber.

3. The deadblow hammer of claim 2, further comprising a wedge for wedging the handle to the handle chamber.

4. The deadblow hammer of claim 1, wherein the impact surface comprises a plurality of bumps.

5. The deadblow hammer of claim 1, wherein the handle comprises a handle grip.

6. A deadblow hammer comprising a hammer head comprising an impact surface, defining an impact plane, comprising a plurality of bumps; a nail pulling claw; a handle chamber defining a handle axis; and a handle attached to the handle chamber; the hammer head comprising an opening, positioned on a plane at an angle to the impact plane, in communication with an anti-recoil chamber, positioned substantially to one side of the handle axis; said anti-recoil chamber comprising at least three distinct cross-sectional dimensions; and wherein a plurality of insert elements is disposed in the anti-recoil chamber by way of the opening, which is sealed subsequent to placing the plurality of insert elements into the anti-recoil chamber.

7. The deadblow hammer of claim 6, wherein the first dimension is larger than the second dimension, which is larger than the third dimension.

8. The deadblow hammer of claim 6, wherein the handle extends through the handle chamber such that the handle is visible from two open ends of the handle chamber.

9. The deadblow hammer of claim 6, further comprising a wedge for wedging the handle to the handle chamber.

10. The deadblow hammer of claim 6, wherein the opening is positioned on a plane perpendicular to the impact plane.

11. The deadblow hammer of claim 6, wherein the insert elements comprise metal pellets.

12. The deadblow hammer of claim 6, wherein the handle comprises a hand grip.

13. The deadblow hammer of claim 6, wherein the hammer head has a weight and wherein the plurality of insert elements have a combined weight of about 30% to about 70% of the weight of the hammer head.

* * * * *

UNITED STATES PATENT AND TRADEMARK OFFICE

CERTIFICATE OF CORRECTION

PATENT NO. : 7,134,363 B2
APPLICATION NO. : 11/106126
DATED : Nov. 14, 2006
INVENTOR(S) : Krallman It is certified that error appears in the above-identified patent and that said Letters Patent is hereby corrected as shown below:

| | |
|---|---|
| Column 8, line 20, Claim 1 | Delete "smaller than the",<br>Insert --smaller than an-- |

Signed and Sealed this

Tenth Day of April, 2007

JON W. DUDAS
*Director of the United States Patent and Trademark Office*